US010753699B2

(12) United States Patent
Klett et al.

(10) Patent No.: US 10,753,699 B2
(45) Date of Patent: Aug. 25, 2020

(54) FLOW THROUGH SUPPRESSOR WITH ENHANCED FLOW DYNAMICS

(71) Applicant: UT-Battelle, LLC, Oak Ridge, TN (US)

(72) Inventors: James W. Klett, Knoxville, TN (US); William C. Moss, San Mateo, CA (US); Andrew T. Anderson, Livermore, CA (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 16/594,189

(22) Filed: Oct. 7, 2019

(65) Prior Publication Data

US 2020/0109907 A1 Apr. 9, 2020

Related U.S. Application Data

(60) Provisional application No. 62/742,480, filed on Oct. 8, 2018.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32
USPC ..... 89/14.4; 181/223
See application file for complete search history.

(56) References Cited

U.S. PATENT DOCUMENTS 748,157 A * 12/1903 Eaastman ..... F01N 1/084 181/265
863,342 A * 8/1907 Alber ..... F01N 1/22 181/271
916,885 A * 3/1909 Maxim ..... F41A 21/30 181/223
1,004,665 A * 10/1911 Lewis ..... F41A 21/30 89/14.1
2,423,109 A * 7/1947 Monnet ..... F41A 13/12 89/14.1
3,354,986 A * 11/1967 Griffin ..... F01N 13/18 181/269

(Continued)

OTHER PUBLICATIONS

International Search Report and Written Opinion in International Application No. PCT/US2019/054919, dated Apr. 13, 2020.

(Continued)

*Primary Examiner* — Derrick R Morgan
(74) *Attorney, Agent, or Firm* — Warner Norcross + Judd LLP

(57) ABSTRACT

An improved firearm suppressor is provided. The firearm suppressor generally includes a primary flow path and a secondary flow path. The primary flow path is centrally disposed within the suppressor and includes multiple internal chambers that are separated by conical baffles. The secondary flow path is helically disposed within the firearm suppressor. A diverter directs a portion of the propellant gas rearward, over a firearm barrel, before entering spiral lanes in the forward direction. The primary flow path slows the movement of propellant gas escaping through a projectile exit port, while the secondary flow path slows the movement of propellant gas escaping through a plurality of propellant gas exit ports.

18 Claims, 9 Drawing Sheets

(56) References Cited

U.S. PATENT DOCUMENTS

| | | | | | |
|---|---|---|---|---|---|
| 3,399,597 | A * | 9/1968 | Perrine | F41A 21/30 | 89/14.4 |
| 3,786,895 | A * | 1/1974 | Perrine | F01N 1/003 | 181/223 |
| 5,029,512 | A * | 7/1991 | Latka | F41A 21/30 | 181/223 |
| 8,286,750 | B1 * | 10/2012 | Oliver | F41A 21/30 | 181/223 |
| 8,474,361 | B2 * | 7/2013 | Brittingham | F41A 21/30 | 42/76.1 |
| 8,875,612 | B1 * | 11/2014 | Klett | F41A 21/30 | 89/14.4 |
| 8,967,325 | B1 * | 3/2015 | Cronhelm | F41A 13/00 | 181/223 |
| 8,991,551 | B2 * | 3/2015 | Latka | F41A 21/30 | 181/223 |
| 9,052,152 | B2 * | 6/2015 | Moss | F41A 21/30 | |
| 9,102,010 | B2 * | 8/2015 | Wilson | F41A 21/30 | |
| 9,347,727 | B1 * | 5/2016 | Cler | F41A 21/30 | |
| 9,500,427 | B1 * | 11/2016 | Larue | F41A 21/30 | |
| 10,393,463 | B1 * | 8/2019 | Sanders | F41A 21/30 | |
| 2004/0154462 | A1 * | 8/2004 | Ang | F41A 21/30 | 89/14.2 |
| 2008/0271944 | A1 * | 11/2008 | Brittingham | F41A 21/30 | 181/223 |
| 2011/0056111 | A1 * | 3/2011 | Brittingham | F41A 21/30 | 42/90 |
| 2012/0048100 | A1 * | 3/2012 | Davies | F41A 21/34 | 89/14.2 |
| 2012/0199330 | A1 * | 8/2012 | Maurer | F28D 7/1669 | 165/168 |
| 2013/0319790 | A1 * | 12/2013 | Bladen | F41A 21/30 | 181/223 |
| 2014/0224574 | A1 * | 8/2014 | Latka | F41A 21/30 | 181/223 |
| 2015/0101882 | A1 * | 4/2015 | Moss | F41A 21/30 | 181/223 |
| 2016/0161203 | A1 * | 6/2016 | Wilson | B23K 35/304 | 89/14.3 |
| 2017/0067711 | A1 * | 3/2017 | Slack | F41A 21/30 | |
| 2017/0205174 | A1 * | 7/2017 | Petersen | F41A 21/30 | |
| 2017/0299313 | A1 * | 10/2017 | Adamson, Jr. | F41A 21/30 | |
| 2017/0321985 | A1 * | 11/2017 | Bray | F41A 21/34 | |
| 2018/0135932 | A1 * | 5/2018 | Tomczak | F41A 21/30 | |
| 2018/0209757 | A1 * | 7/2018 | Hibbitts | F41A 21/30 | |
| 2018/0252489 | A1 * | 9/2018 | Parker | F41A 21/30 | |
| 2018/0292160 | A1 * | 10/2018 | Petersen | F41A 21/30 | |
| 2018/0313626 | A1 * | 11/2018 | Tomczak | F41A 21/325 | |
| 2019/0093973 | A1 * | 3/2019 | Hamby | F41A 21/30 | |
| 2019/0242667 | A1 * | 8/2019 | Lo | F41A 21/30 | |
| 2019/0257607 | A1 * | 8/2019 | Dobrinescu | F41A 21/30 | |
| 2020/0025490 | A1 * | 1/2020 | Facchini | F41A 21/30 | |
| 2020/0025496 | A1 * | 1/2020 | Parker | F41A 21/30 | |
| 2020/0049442 | A1 * | 2/2020 | Petersen | F41A 21/30 | |
| 2020/0072571 | A1 * | 3/2020 | Washburn, III | F41A 21/30 | |
| 2020/0103194 | A1 * | 4/2020 | Oliver | F41A 21/32 | |

OTHER PUBLICATIONS

Nicholas C. [2016] "OSS Suppressor Live Fire Test—The Firearm Blog" posted on Jan. 21, 2016. Accessed on Apr. 8, 2020.

* cited by examiner

| | Sound Level [dB] | | |
|---|---|---|---|
| | OFF AXIS ANGLE | | |
| | 10° (1m) | 90° (1m) | Ear |
| bare | 174.4 | 168.0 | 161.9 |
| Delta P | 156.4 | 147.5 | 147.6 |
| Surefire | 156.0 | 143.3 | 143.4 |
| Phoenyx | 153.4 | 140.4 | 142.9 |

FIG. 6

FLOW THROUGH SUPPRESSOR WITH ENHANCED FLOW DYNAMICS

CROSS-REFERENCE TO RELATED APPLICATION

This application claims the benefit of U.S. Provisional Application 62/742,480, filed Oct. 8, 2018, the disclosure of which is incorporated by reference in its entirety.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

FIELD OF THE INVENTION

The present invention relates to noise and flash suppressors for attachment to firearms.

BACKGROUND OF THE INVENTION

Suppressors include muzzle devices that reduce a firearm's muzzle flash and acoustic output by slowing escaping gases when a firearm is discharged. Suppressors typically include one or more expansion chambers within a tubular body that surround the projectile path to decelerate and cool the escaping gases. These expansion chambers are divided by baffles, with several expansion chambers along the length of the tubular body being used in several modern constructions. Suppressors can be a detachable accessory for attachment to a muzzle or can be integrally joined to the barrel of a firearm, typically referred to as an integral suppressor.

Despite their general acceptance, there remains a continued need for an improved suppressor as a detachable accessory or as an integral suppressor. In particular, existing suppressors, when tested by the present inventors, were found to exhibit an undesirable noise output that was highly dependent upon on location relative to the suppressor. Computational fluid dynamics (CFD) analysis also indicated a risk of secondary ignition due to the intermixing of the hot expelling gases and fresh air. Accordingly, there remains a continued need for an improved suppressor, optionally with improvements in temperature, acoustics, and/or flash over existing suppressor constructions.

SUMMARY OF THE INVENTION

An improved firearm suppressor is provided. The firearm suppressor generally includes a primary flow path and a secondary "flow-through" flow path. The primary flow path is centrally disposed within the suppressor and includes multiple internal chambers that are separated by conical baffles. The secondary flow path is helically disposed within the firearm suppressor. A diverter directs a portion of the propellant gas rearward, over the firearm barrel, before entering spiral lanes in the forward direction. The primary flow path slows the movement of propellant gas escaping through a projectile exit port, while the secondary flow path slows the movement of propellant gas escaping through a plurality of propellant gas exit ports.

In one embodiment, the firearm suppressor includes a reflex-type barrel end that is adapted to fit over a firearm barrel. The firearm suppressor also includes a receiving chamber for propellant gas. The receiving chamber diverts a portion of the propellant gas rearward through an annular channel, over the firearm barrel, before entering a plurality of spiral lanes in the forward direction. The spiral lanes terminate at a circular array of gas exit ports. At least some of the spiral lanes include an opening in fluid communication with the primary flow path, the opening being forward of the receiving chamber. The primary flow path terminates at the projectile exit port, which is surrounded by a circular array of propellant gas exit ports.

In operation, propellant gas enters the receiving chamber under high pressure and temperature. The receiving chamber diverts a portion of the propellant gas rearward along the secondary "flow-through" flow path while allowing a portion of the propellant gas to travel forward along the primary flow path. Propellant gas in the secondary flow path enters some or all of the spiral lanes, moving forward within the suppressor and drawing additional propellant gas from the primary flow path through internal openings. The propellant gas remaining in the primary flow path continues its progression along each expansion chamber. Propellant gas escapes the suppressor via the projectile exit port and the array of propellant gas exit ports, collectively reducing the muzzle flash and acoustic output.

The suppressor of the present invention manages propellant gases by separating the gases into multiple gas streams and by retaining the expanding gases in the suppressor for a reduced time frame, thus lessening the transfer of heat to the suppressor. In comparative testing with existing suppressors, the suppressor of the present invention demonstrated a reduced flash signature and improved acoustic performance. Suppressors according to the present invention are well suited for use as a detachable accessory or as an integral suppressor for pistols, rifles, and other firearms. These and other features of the invention will be more fully understood and appreciated by reference to the description of the embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

BRIEF DESCRIPTION OF THE DRAWINGS

FIG. 6 is a table including comparative acoustic data for the suppressor of FIGS. 1-3.

DETAILED DESCRIPTION OF THE CURRENT EMBODIMENTS

Figure 1:
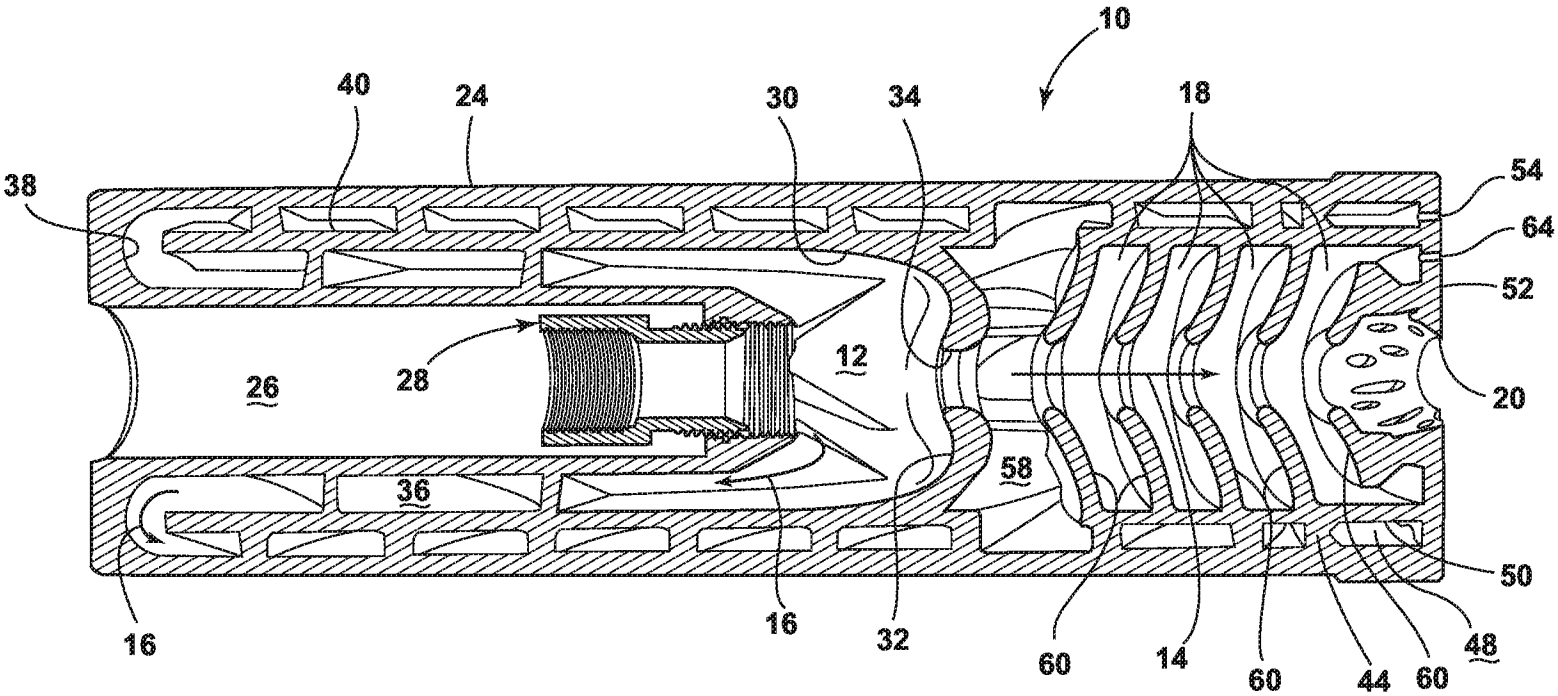
FIG. 1 is a cross-sectional view of a suppressor in accordance with a first embodiment.
Figure 2:
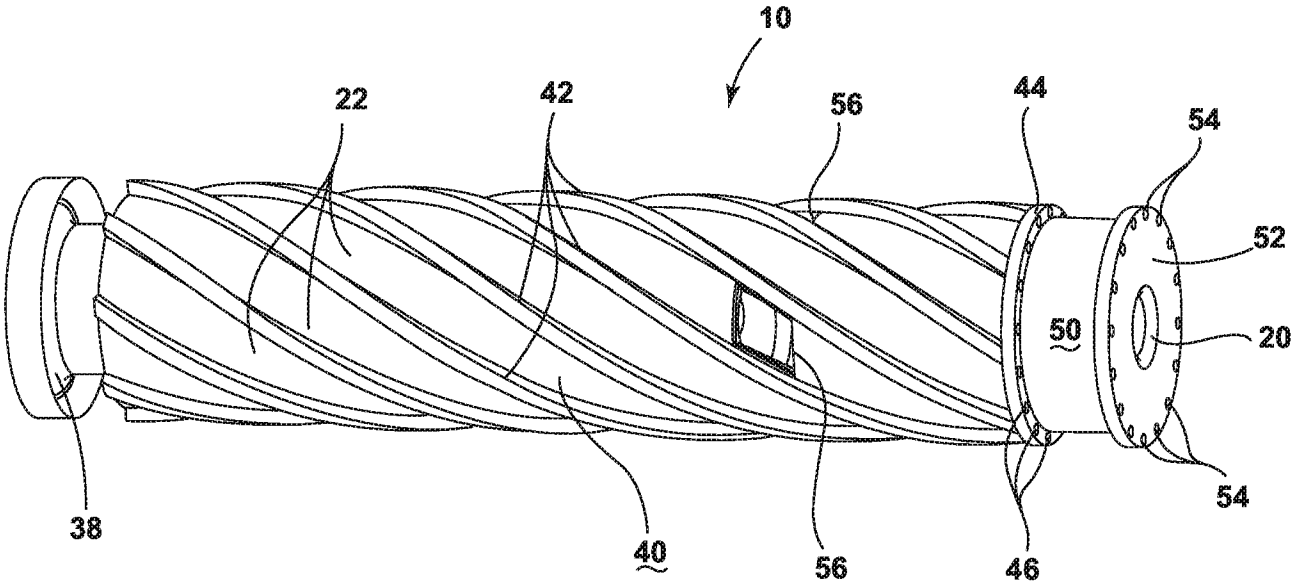
FIG. 2 is a side perspective view of the suppressor of FIG. 1 with the exterior sidewall removed.
Figure 3:
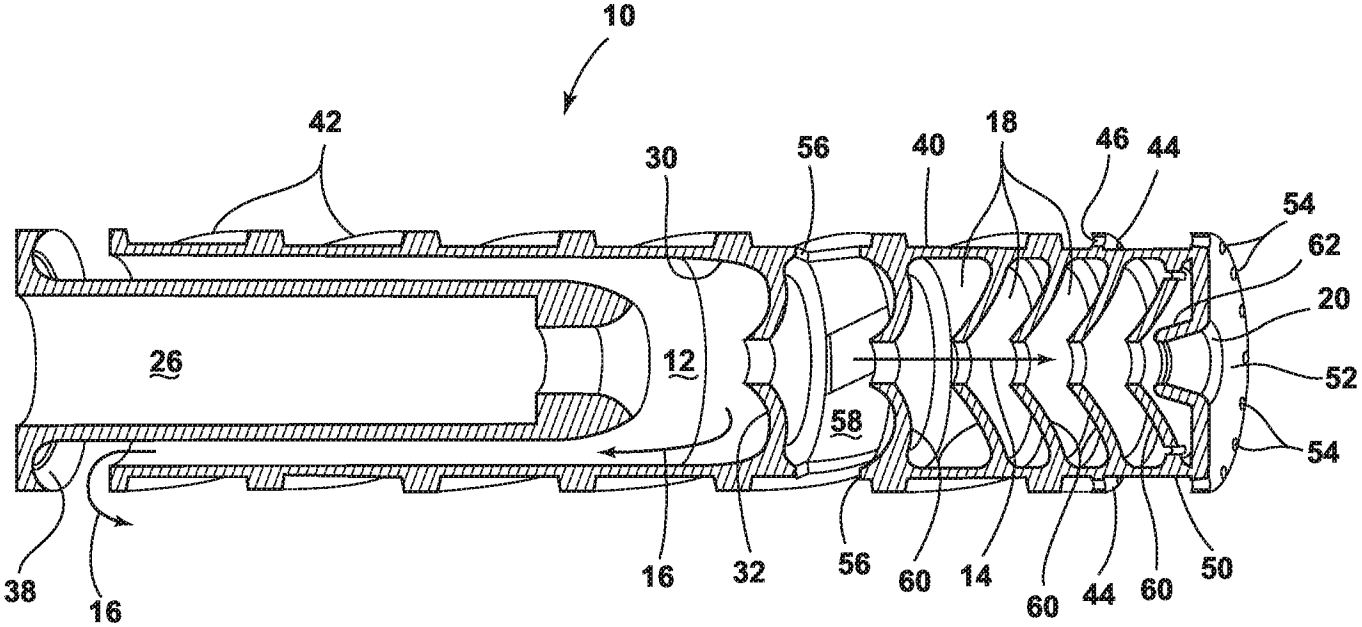
FIG. 3 is a further cut-away view of the suppressor of FIG. 1 with the exterior sidewall removed.

Referring now to FIGS. 1-3, a suppressor in accordance with a first embodiment is illustrated and generally designated 10. The suppressor 10 includes a propellant gas receiving chamber 12, a primary flow path 14, and a secondary flow path 16. The receiving chamber 12 is in fluid communication with a firearm muzzle (not shown) and is in fluid communication with the primary flow path 14 and the secondary flow path 16. The primary flow path 14 is centrally located within the suppressor 10 and includes a plurality of expansion chambers 18, terminating at a projectile exit port 20. The secondary flow path 16 is helically disposed around the primary flow path 14, and includes multiple spiral lanes 22, at least some of which are in fluid communication with the primary flow path 14. As discussed below, the receiving chamber 12 diverts a portion of the propellant gas rearward, over a firearm barrel, before entering the spiral lanes 22 in the forward direction, while the remainder of the propellant gas progresses along the expansion chambers 18 before exiting the suppressor 10.

More particularly, the suppressor 10 includes an elongated tubular housing adapted to be joined to a firearm muzzle, integrally or as a detachable accessory. In the embodiment show in FIGS. 1-3, the elongated tubular housing is adapted to be joined to a firearm muzzle as a detachable accessory. The elongated tubular housing includes an exterior sidewall 24 and a barrel end opening 26 that is sized to extend over a firearm barrel as a 'reflex-type' suppressor, the barrel end opening 26 having a greater diameter than an externally threaded portion of the firearm. The barrel end opening 26 extends along a substantial portion of the length of the exterior sidewall 24, for example at least 25% of the length of the exterior sidewall 24, further optionally at least 40% of the exterior sidewall 24. Within the barrel end opening 26, a first end of a throat insert 28 is internally threaded to threadably receive an externally threaded firearm muzzle. A second end of the throat insert 28 is externally threaded to threadably engage an internally threaded opening of the firearm suppressor 10. The throat insert 28 communicates propellant gas from the firearm barrel to the propellant gas receiving chamber 12. In other embodiments, however, the firearm suppressor 10 is joined to the firearm muzzle without the aid of the throat insert 28.

As noted above, propellant gas first enters the propellant gas receiving chamber 12 by way of the throat insert 28. The propellant gas receiving chamber 12 includes an annular sidewall 30 and a curved endwall 32. The curved endwall 32 defines a concave annular recess surrounding a projectile opening 34, such that the curved endwall 32 diverts a portion of the propellant gas rearward along an annular channel 36. The diameter of the opening in the curved endwall 32, or "diverter 32" as referred to herein, is smaller than the diameter of the opening leading into the receiving chamber 12, such that only a portion of the propellant gas progresses to the primary flow path 14. The remainder of the propellant gas is diverted rearward by the diverter 32 and continues along the annular channel 36, parallel to the barrel end opening 26.

At the extreme rearward end of the annular channel 36, the propellant gas reaches a disc-shaped endwall 38 (or proximal endwall). The disc-shaped endwall 38 includes a concave annular trough with sloping sides, such that the rearward moving propellant gas reverses direction and continues the secondary flow path 16 in the forward direction. An interior sidewall 40 extends in the lengthwise direction of the suppressor 10. The interior sidewall 40 is axially offset from the disc-shaped endwall 38, such that the propellant gas may reverse direction and enter a plurality of spiral lanes 22. The spiral lanes 22 (best shown in FIG. 2) are defined by the interior sidewall 40, the exterior sidewall 24, and a plurality of helical partitions 42. The plurality of helical partitions 42 interconnect the interior sidewall 40 and the exterior sidewall 24 and extend along a substantial portion of the length of the suppressor, optionally at least 50% of the length of the suppressor 10, further optionally at least 80% of the length of the suppressor 10. While the interior sidewall 40 is illustrated as being cylindrical and parallel to the exterior sidewall 24, the interior sidewall 40 may instead be sloped with respect to the exterior sidewall 24, such that the interior sidewall 40 forms a section of a cone (rather than a cylinder). In this respect, the spiral lanes 22 may define a constant cross-section along their length or may define a diverging or converging cross-section along their length.

In the embodiment depicted in FIGS. 1-3, the forward portion of the secondary flow path 16 includes eight spiral lanes 22, however greater or fewer number of spiral lanes can be used in other embodiments. The spiral lanes 22 terminate at an annular flange 44 in a forward portion of the suppressor 10, the annular flange 44 interconnecting the interior sidewall 40 and the exterior sidewall 24. In the illustrated embodiment, the annular flange 44 includes a circular array of sixteen through-holes 46, or two through-holes for each of the spiral lanes, such that propellant gas exiting each spiral lane will enter an annular chamber 48 via two through-holes. A greater or fewer number of through-holes can be used in other embodiments as desired. The annular chamber 48 includes a cylindrical wall section 50. The annular chamber 48 is also bounded by the annular flange 44 and the end plate 52 (or distal endwall), the end plate 52 having a corresponding number of propellant gas exit ports 54. The propellant gas exit ports 54 constitute the end of the second flow path 16, and are disposed concentrically around the projectile exit port 20. The through-holes 46 and the propellant gas exit ports 54 are in alignment with each other in the current embodiment, being axially offset from each other, defining small cylindrical passages through the flange 44 and the end plate 52, respectively.

The primary flow path 14 is in fluid communication with the secondary flow path 16 through a plurality of openings 56 in the interior sidewall 40, shown in FIG. 2. In the current embodiment, alternating ones of the spiral lanes 22 are open to an intermediate chamber 58 in the primary flow path 14. In other embodiments, the ratio of spiral lanes 22 that are open to the intermediate chamber 58 can differ. Instead of a 1:1 ratio, for example, the ratio of spirals lanes 22 that are open to the intermediate chamber 58 relative to the remaining spiral lanes can be 2:1 or 1:2. As shown in FIGS. 1 and 3, the intermediate chamber 58 is serially disposed between the propellant gas receiving chamber 12 and the plurality of expansion chambers 18. A single intermediate chamber is illustrated in the current embodiment, however a greater number of intermediate chambers can be used in other embodiments. A portion of the propellant gas moving through the intermediate chamber 58 is drawn radially outward by the fast moving, low pressure propellant gas in the spiral lanes 22, thereby reducing the volume flow rate of propellant gas proceeding through the primary flow path 14. The primary flow path 14 in turn includes a plurality of serially disposed baffles 60 (five in the illustrated embodiment) extending radially inward and rearward from the interior sidewall 40. The plurality of baffles 60 define four expansion chambers 18 in the illustrated embodiment, however greater or fewer number of expansion chambers can be used in other embodiments. Each baffle 60 defines a generally conical wall having a projectile port which is aligned with the projectile exit port 20. Optionally shown in FIG. 3, a frustoconical sidewall 62 is joined to the end plate 52, the frustoconical sidewall 62 including a diverging cross-section to slow the escaping propellant gas.

In operation, the projectile passes through the suppressor 10, and in particular through the projectile ports of each of the baffles 60. A majority of the propellant gas from the bore of the firearm enters the propellant gas receiving chamber 12 at high pressure. Within the propellant gas receiving chamber 12, a portion of the propellant gas is diverted rearward along the secondary flow path 16. Propellant gas in the secondary flow path 16 enters each of the spiral lanes 22, moving forward toward the end plate 44, drawing additional propellant gas through the openings 56 leading to the intermediate chamber 58. The propellant gas remaining in the primary flow path 14 continues its progression through each expansion chamber 18 along the primary flow path 14. The propellant gas within the primary flow path 14 exits the suppressor via the projectile port 20, while the propellant gas within the secondary flow path 16 exits through the circular array of propellant gas exit ports 54. As optionally shown in FIG. 1, propellant gas may additionally escape the last expansion chamber through an exit port 64.

Figure 4:
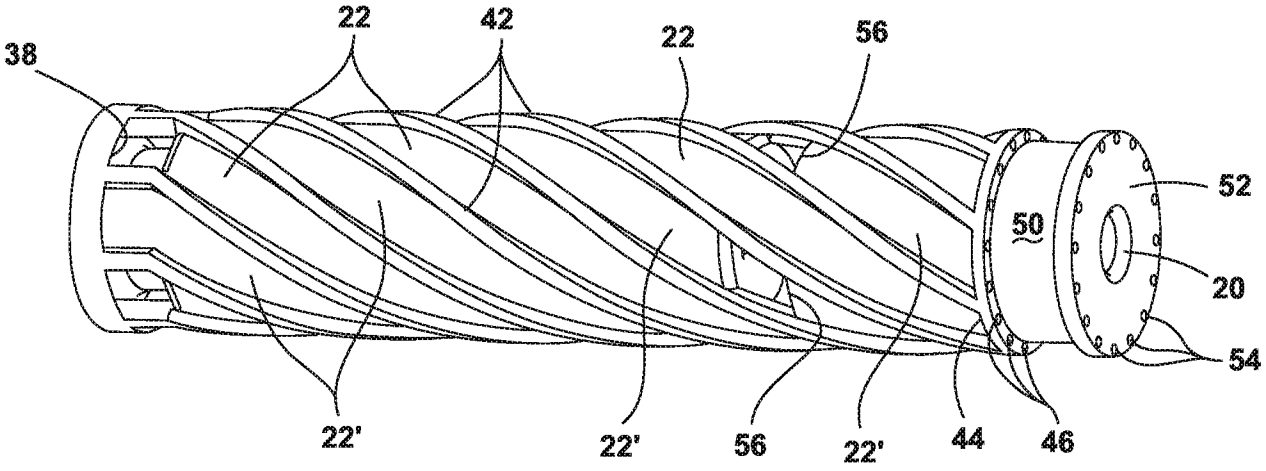
FIG. 4 is a side perspective view of a suppressor in accordance with a second embodiment with the exterior sidewall removed.
Figure 5:
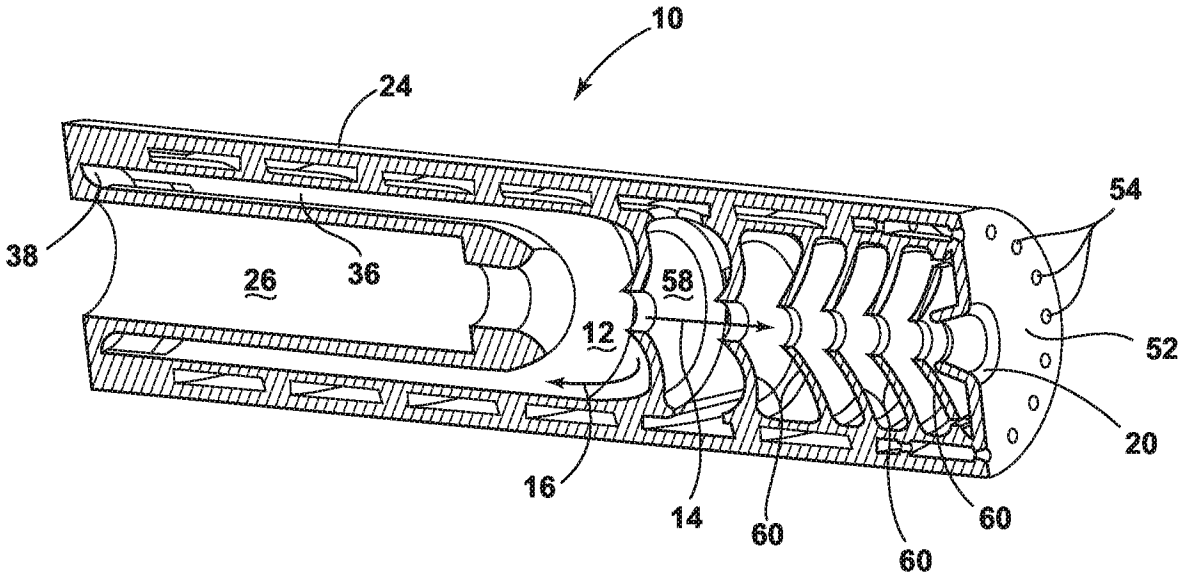
FIG. 5 is a cut-away view of the suppressor of FIG. 1.

The embodiment of FIGS. 4-5 is structurally and functionally similar to the embodiment of FIGS. 1-3, except that a portion of the spiral lanes 22 are closed off to propellant gas moving rearward from the propellant gas receiving chamber 12. Four of the eight spiral lanes 22 are in fluid communication with the annular channel 36 in the illustrated embodiment, with greater or fewer spiral lanes 22 being in fluid communication with the annular channel 36 in other embodiments. This propellant gas is diverted in the manner described above in connection with FIGS. 1-3, in that a disc-shaped endwall 38 reverses the direction of the propellant gas. Because the interior sidewall 40 is axially offset from the disc-shaped endwall 38, propellant gas enters four of the eight spiral lanes 22. The remaining four lanes 22' are sealed off from the annular channel 36, such that the interior sidewall 40 is joined to the endwall 38. These remaining four lanes 22' are open to the intermediate chamber 58 through one or more openings 56 in the interior sidewall 40. In operation, high pressure propellant gas within the intermediate chamber 58 enters the sealed-off spiral lanes 22' through the openings 56 in the interior sidewall 40, traveling in both directions (forward and rearward), lowering the pressure in the intermediate chamber 58. Propellant gas traveling in the forward direction enters the annular chamber 48 and escapes through the plurality of propellant gas exit ports 54, while propellant gas within the primary flow path 14 exits the suppressor 10 via the projectile port 20.

Example

Figure 7:
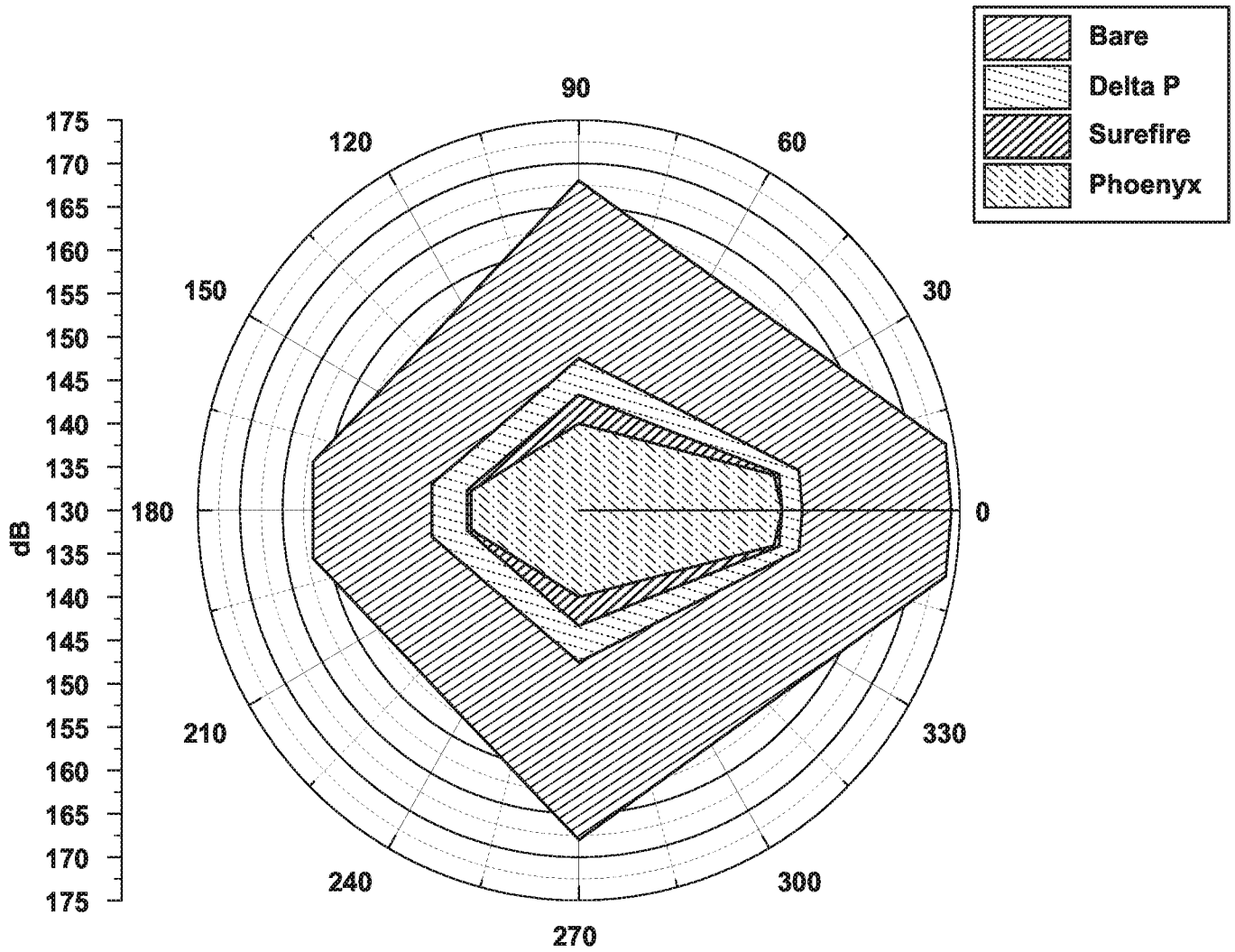
FIG. 7 is a polar graph including comparative acoustic data for the suppressor of FIGS. 1-3.
Figure 8:
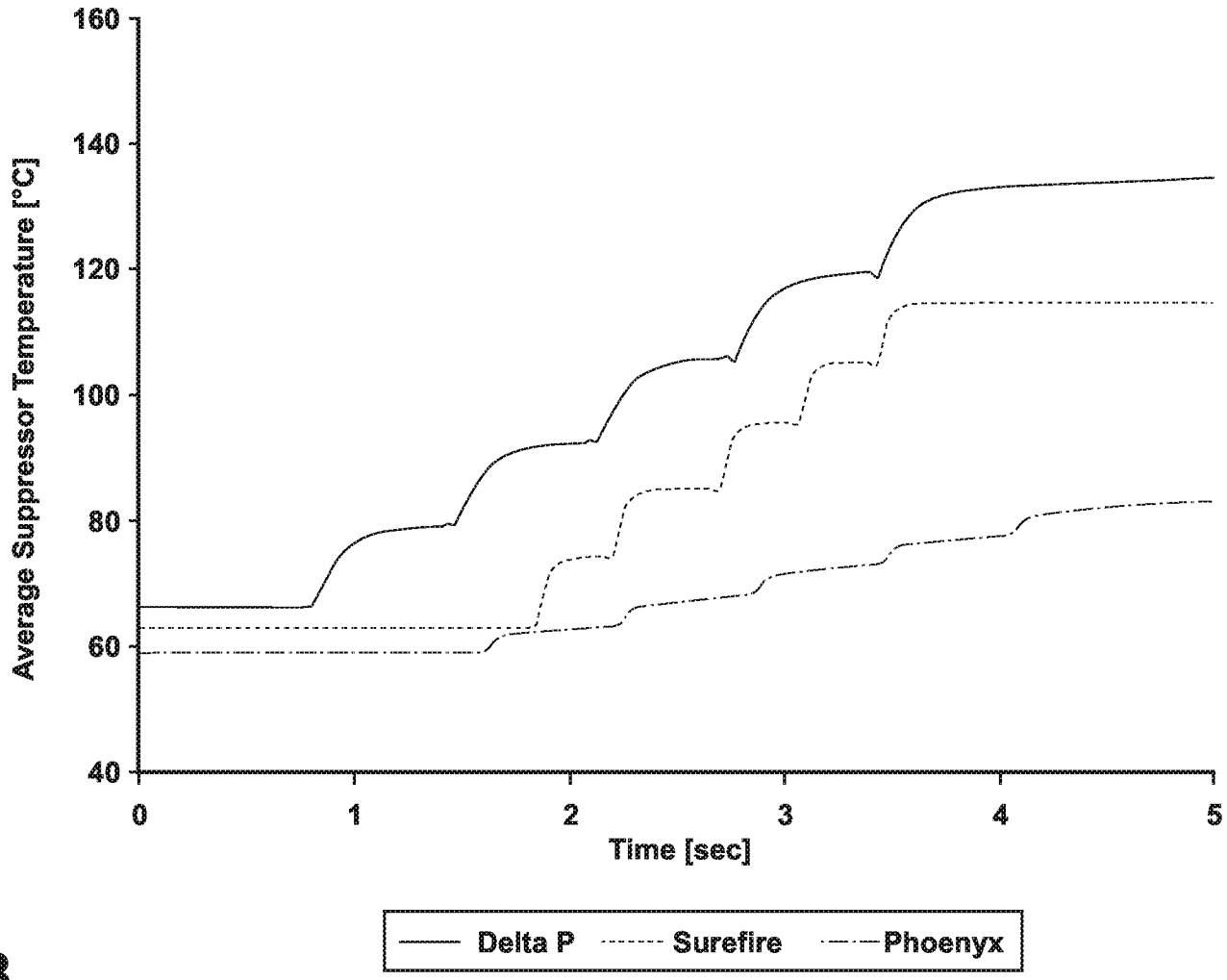
FIG. 8 is a graph including comparative data for average suppressor temperature over time during a five-shot sequence.
Figure 9:
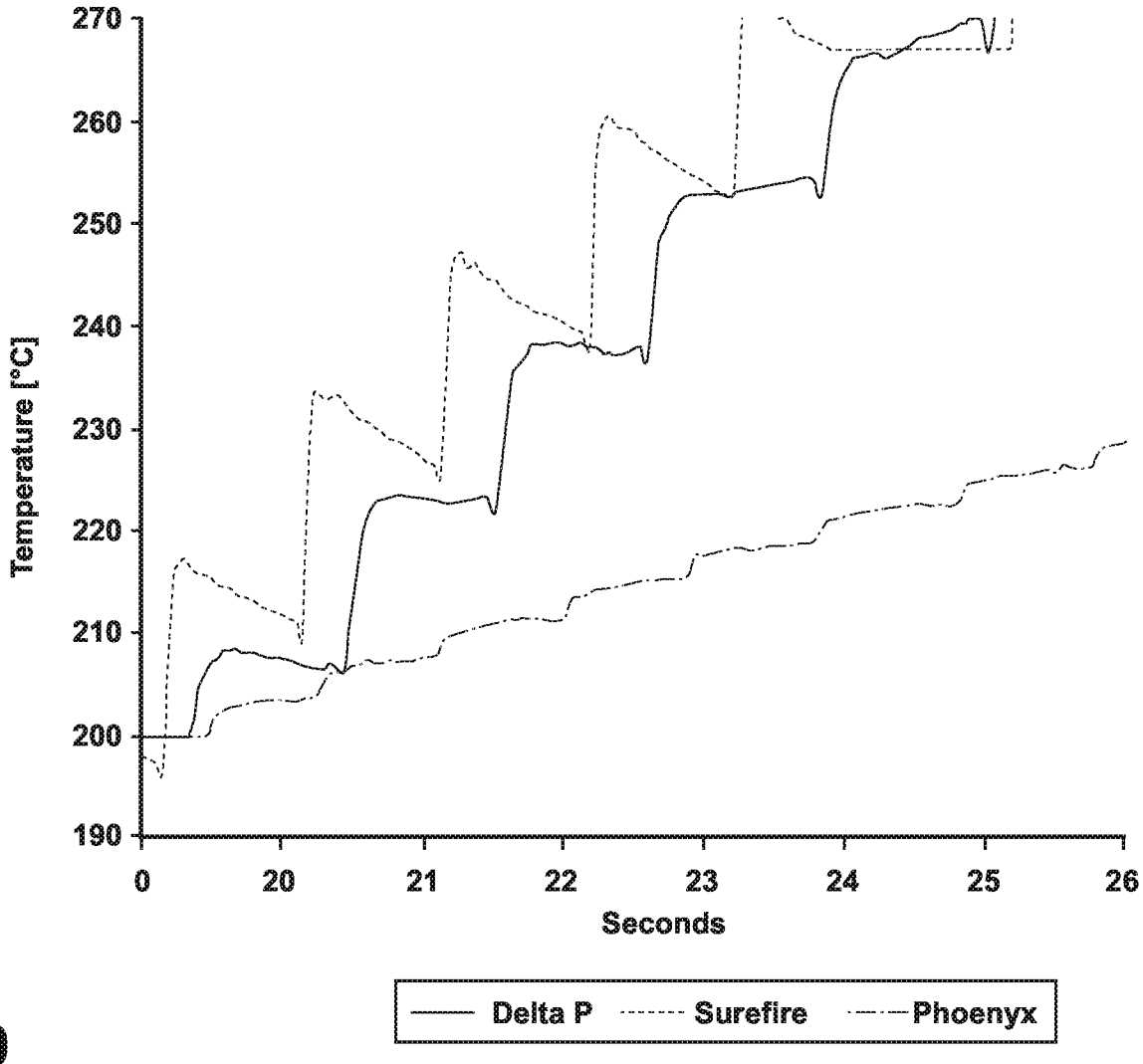
FIG. 9 is a graph including comparative data for temperature rise in an endurance test with a second magazine.

In the present example, a suppressor manufactured in accordance with the embodiment of FIGS. 1-3 ("Phoenyx") was tested against the SureFire SOCOM556-SB2 Sound Suppressor and the Delta P-Brevis II 5.56 Ultra using a 16-inch 5.56 caliber rifle with M855 ammunition. Acoustics were evaluated at 10° at 1 meter, 90° at 1 meter, and the shooter's ear. Acoustic results are shown at FIG. 6. The Delta P-Brevis II exhibited the highest sound level, followed by the SureFire SB2 and the Phoenyx. The Phoenyx was the only suppressor tested to exhibit a sound level of near 140 dB at 90°, which is the target sound level for suppressors deemed hearing safe by ARDEC. A polar plot is illustrated at FIG. 7, which includes a sound map of the three tested suppressors compared to a bare muzzle, showing favorable performance by the Phoenyx. Flash testing indicated that the Phoenyx exhibited a significantly reduced flash signature after the first shot in a five shot sequence, comparable to the SureFire SB2 and significantly improved over the Delta P-Brevis II. FIG. 8 includes the temperature rise as a function of time for each suppressor over a five-shot sequence. The Delta P-Brevis II exhibited a significant temperature rise with each shot, while the Phoenyx exhibited a reduced temperature per shot. In particular, the Phoenyx absorbed about 3.5° C. per shot compared to over 17° C. for the other tested suppressors. Similar results are depicted in FIG. 9 in an endurance test after a second magazine.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A firearm suppressor comprising:

an inner sidewall defining a primary flow path for propellant gas, the primary flow path including a plurality of serially arranged expansion chambers separated by baffles;

an outer sidewall disposed in circumferentially spaced relation with the inner sidewall surface and defining a secondary flow path;

a propellant gas receiving chamber for separating the secondary flow path from the primary flow path, the secondary flow path progressing rearward toward a proximal endwall, wherein the proximal endwall includes a concave annular recess for reversing the direction of the propellant gas forward;

a plurality of helical partitions interconnecting the inner sidewall and the outer sidewall to define a plurality of spiral lanes as part of the secondary flow path, at least one of the plurality of spiral lanes being in fluid communication with the primary flow path through an opening in the inner sidewall; and a distal endwall joined to the inner sidewall and the outer sidewall and defining a projectile exit port and a plurality of propellant gas exit ports, the plurality of propellant gas exit ports disposed radially outward of the projectile exit port and in communication with the secondary flow path for discharging propellant gas.

2. The firearm suppressor of claim 1 wherein the propellant gas receiving chamber includes a concave surface for directing propellant gas rearward through an annular channel.

3. The firearm suppressor of claim 1 wherein the proximal endwall is spaced apart from an end of the inner sidewall along the entirety of the proximal endwall.

4. The firearm suppressor of claim 1 wherein the proximal endwall is spaced apart from an end of the inner sidewall along only a portion of the proximal endwall.

5. The firearm suppressor of claim 1 further defining an intermediate chamber between the propellant gas receiving chamber and the plurality of expansion chambers.

6. The firearm suppressor of claim 5 wherein the intermediate chamber is in fluid communication with alternating ones of the plurality of spiral lanes through a plurality of openings in the inner sidewall.

7. The firearm suppressor of claim 1 wherein the plurality of propellant gas exit ports are disposed in a circular array about the projectile exit port.

8. The firearm suppressor of claim 1 wherein the baffles are generally conical baffles each defining a projectile port in alignment with the projectile exit port.

9. The firearm suppressor of claim 1 further including a throat insert for attachment to an externally threaded firearm muzzle.

10. A firearm suppressor comprising:

a housing including exterior sidewall, a proximal endwall, and a distal endwall, the distal endwall defining a projectile exit port and a plurality of propellant gas exit ports;

a cylindrical sidewall within the housing, the cylindrical sidewall extending generally parallel to the exterior sidewall and being concentrically spaced apart from the exterior sidewall;

a plurality of baffles joined to the cylindrical sidewall to form a plurality of expansion chambers, each of the plurality of baffles including a projectile port in alignment with the projectile exit port to define a primary flow path;

a plurality of helical partitions interconnecting the cylindrical sidewall and the exterior sidewall to define a plurality of spiral lanes as part of a secondary flow path, at least one of the plurality of spiral lanes being in fluid communication with the primary flow path through an opening in the cylindrical sidewall; and a diverter joined to the cylindrical sidewall to allow a first portion of propellant gas forward along the primary flow path and to divert a second portion of propellant gas rearward along the secondary flow path, wherein the proximal endwall includes a concave annular recess for reversing the direction of propellant gas forward, wherein the primary flow path is adapted to discharge propellant gas through the projectile exit port and the secondary flow path is adapted to discharge propellant gas through the plurality of propellant gas exit ports.

11. The firearm suppressor of claim 10 wherein the diverter includes a further concave annular surface for directing the second portion of propellant gas rearward through an annular channel.

12. The firearm suppressor of claim 10 wherein the proximal endwall is spaced apart from an end of the interior sidewall along the entirety of the proximal endwall.

13. The firearm suppressor of claim 10 wherein the proximal endwall is spaced apart from an end of the interior sidewall along only a portion of the proximal endwall.

14. The firearm suppressor of claim 10 wherein a first one of the plurality of baffles is axially offset from the diverter to define an intermediate chamber therebetween.

15. The firearm suppressor of claim 14 wherein the intermediate chamber is in fluid communication with alternating ones of the plurality of spiral lanes through a plurality of openings in the cylindrical sidewall.

16. The firearm suppressor of claim 10 wherein the plurality of propellant gas exit ports are disposed in a circular array about the projectile exit port.

17. The firearm suppressor of claim 10 wherein the plurality of baffles are generally conical baffles each defining a projectile port in alignment with the projectile exit port.

18. The firearm suppressor of claim 10 further including a throat insert for joining the housing to an externally threaded firearm muzzle.

* * * * *